United States Patent [19]

Bardin et al.

[11] Patent Number: 4,733,734

[45] Date of Patent: Mar. 29, 1988

[54] METHOD AND IMPROVEMENT TO DRILLING TOOLS COMPRISING WATER PASSAGES PROVIDING GREAT EFFICIENCY IN CLEANING THE CUTTING FACE

[75] Inventors: Christian Bardin, Bois Colombes; Henri Cholet, Le Pecq, both of France

[73] Assignee: Institut Francais du Petrole, France

[21] Appl. No.: 749,285

[22] Filed: Jun. 27, 1985

[30] Foreign Application Priority Data

Jul. 27, 1984 [FR] France ..... 84 10127

[51] Int. Cl.[4] ..... E21B 10/18

[52] U.S. Cl. ..... 175/65; 175/393

[58] Field of Search ..... 175/65, 339, 340, 393, 175/422

[56] References Cited

U.S. PATENT DOCUMENTS

| | | | |
|---|---|---|---|
| 2,807,444 | 9/1957 | Reitschneider | 175/339 |
| 3,220,754 | 11/1965 | Mori | 175/393 |
| 3,746,108 | 7/1973 | Hall | 175/393 |
| 4,296,824 | 10/1981 | Kennington | 175/340 |
| 4,516,642 | 5/1985 | Childers et al. | 175/340 |
| 4,540,056 | 9/1985 | O'Hanlon | 175/393 |

*Primary Examiner*—Stephen J. Novosad
*Assistant Examiner*—William P. Neuder
*Attorney, Agent, or Firm*—Antonelli, Terry & Wands

[57] ABSTRACT

A method and a drilling tool are provided improving removal of spoil during drilling. The method allows the spoil to be removed from a drilling tool rotating, more especially on itself in operation, about a proper axis, or axis of the tool, said tool comprising a body a first end of which is adapted for connection to rotary drive means and the second end of which, said second end comprising water passages, defines the cutting face, the zone of said second end adjacent said axis is called central part of the tool, said tool comprises at least one nozzle. The method consists in positioning said nozzle in a water passage for producing a flow orientated towards the central part of the tool, and since the vector obtained by the orthogonal projection on a plane perpendicular to the axis of the tool of the speed of said flow in the central part of the tool is zero at any point of said central part, said vector will be qualified as effective speed vector.

10 Claims, 7 Drawing Figures

METHOD AND IMPROVEMENT TO DRILLING TOOLS COMPRISING WATER PASSAGES PROVIDING GREAT EFFICIENCY IN CLEANING THE CUTTING FACE

BACKGROUND OF THE INVENTION

1. Field of the Invention

The present invention relates to an improved rotary driling tool having great efficiency in cleaning the cutting face.

2. Description of the Prior Art

Rotary drilling tools are already known comprising a body having a first end which is connected to a rotary drive means and a second end, which delimits the cutting face and which comprises a plurality of working zones distributed about the axis of the drilling bit, while being separated by radial zones for removal of the spoil or cuttings; these zones communicating at their periphery with an annular space surrounding a first end of the drilling bit, in front of the cutting face.

In some tools of this type, described for example in the published British patent application No. GB-A-2 047 308, each of the working zones of the drilling bit comprises a plurality of ribs, or segments, of elongate shape each of which has a working face carrying a cutting element advantageously formed by sintered diamond.

The assembly of the working faces of the same zone form a line for working the ground. Each working zone comprises a row of irrigation nozzles opening along the radius of the cutting face, in front of the working line of this zone, if we consider the direction of rotation thereof on the cutting face. These nozzles create irrigation jets flowing in a direction substantially parallel to the working faces of the ribs, at a certain distance from the working faces.

It is also known to improve the cleaning of the cutting face and removal of the spoil or cuttings by positioning nozzles whose jets are slanted with respect to the cutting face and therefore strike the wall at an angle of incidence different from 90°.

The prior art may be illustrated by the U.S. Pat. Nos. 3,645,346, 3,838,742 and 4,323,130.

A drawback of the prior art resides in the fact that the distribution presently adopted for these jets does not promote good cleaning of the central part of the tool, which limits the advancing rate performance of the tool and increases the wear thereof.

The purpose of the present invention is to provide an improvement to drilling tools to increase their performances by a more efficient removal of spoil from the cutting face and more particularly in the central part, or central zone, of the tool.

SUMMARY OF THE INVENTION

The present invention may be applied to drilling tools or drilling bits working by removing chips (blade tool) or by abrasion comprising water passages. The first tools mentioned generally comprise cutting elements made from synthetic polycrystalline diamond, the second generally comprise natural diamonds.

This objective is reached in accordance with the present invention by slanting one jet of a plurality of jets preferably towards the central part of the tool, the other jets not interfering with this jet.

In the present text, speed is generally meant the mean value of the speed obtained by integrating the speeds over the shortest distance separating the tool from the geological formation.

The jet or jets orientated preferably towards the central part of the tool must be positioned so that the vector of the flow speed obtained by the orthogonal projection on a plane perpendicular to the axis of the tool in the central part of the tool is different from zero. This vector will be called effective speed vector.

With this jet or a plurality of such jets orientated preferably towards the central part of the tool there will be advantageously associated one or more jets whose flow moves away preferably from the central part of the tool and this jet or the plurality of jets not being situated on the straight line segment passing through the axis of the tool and the starting point of the jet orientated preferably towards the central part of the tool; this above mentioned straight line segment is limited by the axis of the tool and by the starting point of the jet preferably orientated towards the central part of the tool.

Thus, the present invention relates to a method improving the scavaging of cuttings from a drilling tool comprising water passages rotating, more especially on itself during operation, about a proper axis, or axis of the tool. This tool comprises a body a first end of which is adapted for connection with rotation drive means and the second end of which delimits the cutting face. The zone of the second end adjacent said axis is called central part of the tool, the tool comprises at least one nozzle.

More exactly, the central part or central zone of the tool is defined by the part of the tool surrounding the center of the tool, itself is defined as being the intersection of the proper axis of the tool with the outer surface of the tool.

The method of the invention is characterized in that said nozzle is positioned so as to produce a flow orientated towards the central part of the tool and in that, the vector obtained by the orthogonal projection on a plane perpendicular to the axis of the tool of the speed of said flow in the central part of the tool is different from being non zero at any point of the central part of the tool, the vector being defined or called the effective speed vector as has heretofore described.

The method of the invention may be applied to the case of a tool comprising several nozzles, in this case these nozzles are positioned and dimensioned so as to produce a resultant flow at the center of the tool whose effective speed vector is different from zero at any point of the central part of the tool.

In a variant of the method of the invention, the nozzle or nozzles are positioned so that there exists at least one axis called circulation axis belonging to the plane perpendicular to the axis of the tool. The orthogonal projections on this axis of the different effective speed vectors of the central part of the tool are called circulation vectors. In this variant, all the circulation vectors are orientated in the same direction.

Of course, said axis may be a curved line. But preferably it is a straight axis passing through the axis of the tool.

The present invention also relates to a drilling tool for implementing the method and its above described variants.

This tool is characterized in that it comprises at least a first injection nozzle positioned in a first water passage of the tool, said nozzle comprising an injection channel whose axis is orientated substantially towards the central zone of the tool.

In a variant, the tool of the invention may comprise at least a second nozzle positioned in a second water passage located on the side of the tool opposite that containing the first nozzle, said side being defined by the portion of the tool situated in the half space defined by a first plane passing through the axis of the tool, perpendicular to the second plane containing a point of the injection orifice of said first nozzle as well as the axis of the tool, said nozzle comprising an injection channel adapted for producing a flow substantially orientated in the direction opposite that defined by the central zone of the tool.

In another variant, the point of the injection orifice of the second injection nozzle may be positioned in a water passage substantially located on said opposite side of the tool.

In another variant, the tool may comprise several fluid injection nozzles having fluid injection channels whose axis is orientated towards the central zone of the tool. These nozzles being positioned in water passages located on the tool on the same side with respect to a plane passing through the axis of the tool.

In another variant, the tool may comprise a third nozzle having a third channel, said third nozzle being positioned substantially in the vicinity of said first nozzle, the axis of said third channel being orientated substantially in the direction opposite that of the first nozzle.

In another variant, when the drilling tool comprises a number n of water passages greater than or equal to 3, it will comprise a number m of water passages adjacent each other 2 by 2, each of these m passages having at least one injection nozzle. The injection channel of this nozzle being orientated towards the central part of the tool. The number m is preferably between 1 and the whole part of the quotient of the number n divided by two.

In another variant of the tool of the invention, at least one of the water passages other than those equipped with an injection nozzle having a channel with axis orientated towards the central part of the tool may be equipped with at least one injection nozzle comprising a channel substantially orientated in the direction opposite that defined by the central part of the tool.

BRIEF DESCRIPTION OF THE DRAWINGS

The present invention will be better understood and its advantages will be more clearly understood from the following description of a particular example, which is in no wise limitative, illustrated by the accompanying Figures in which.

DESCRIPTION OF THE PREFERRED EMBODIMENTS

Figure 1:
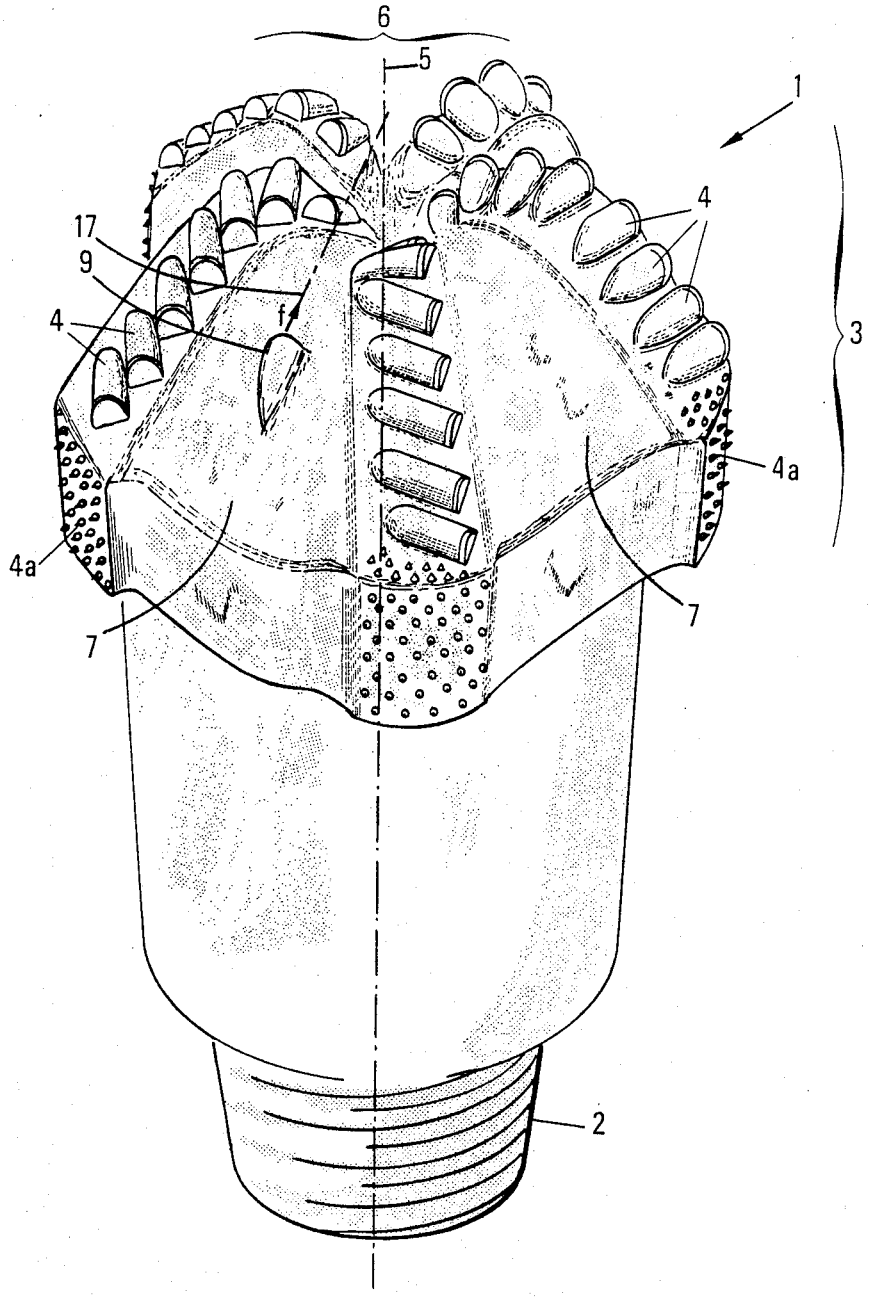
FIG. 1 shows a drilling tool comprising improvements according to the present invention.

In FIG. 1 the reference 1 designates generally the body of the drilling tool or drilling bit of the invention which will for example be made from a special steel. At a first one of its ends, this tool is adapted for connection with rotary drive means, for example by means of a threaded portion 2. The means for rotating the tool will comprise a tool holder to which the drilling bit is secured and which forms part of the rotary drilling string, or which may be directly rotated by the rotor of a bottom motor.

The second end or head 3 of the drilling bit comprises a face defining the cutting face of the tool, this face comprising a plurality of means 4 and 4a for destroying the formation to be drilled.

Reference 5 designates the axis of the tool and reference 6 designates the central part or central zone of the tool which may be defined by way of example by the part of the surface of the second end of the tool included within a cylinder whose axis coincides with the axis 5 of the tool and whose diameter is equal to the external diameter of the tool divided by three.

The drilling head comprises water passages 7. For cleaning and removing the spoil or cuttings, a flow of fluid is formed. The drilling fluid passes from the inner part of the drilling head to the outer annular zone 8 (FIG. 3) between the cutting face and the surface of the tool through nozzles 9 which orientate the fluid directly on the cutting face along a path f.

The spoil is cleared and removed by means of a flow of drilling fluid which is brought by the string of rods as far as the internal cavity of the drilling bit. The fluid is then distributed through a bore to at least a first nozzle 9 having a channel for injection of the fluid whose axis 17 is orientated substantially towards the central zone 6 of the tool.

Figure 2:
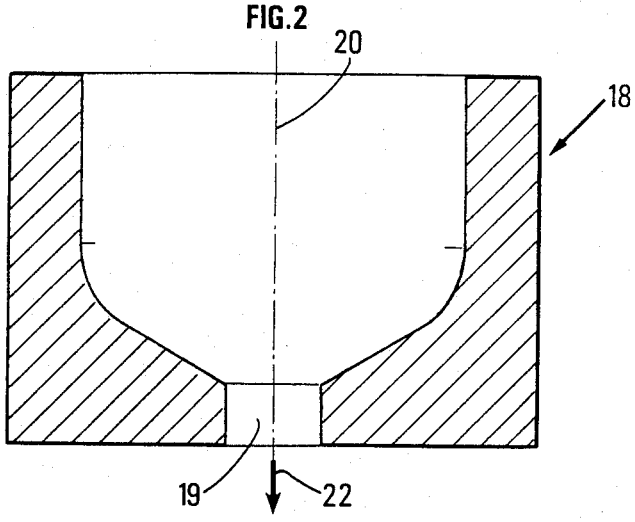
FIG. 2 shows a nozzle.

In the present description, the term "injection channel of the nozzle" means that part of the nozzle which will orientate the direction of the jet, thus, in FIG. 2, the channel of nozzle 18 corresponds to the passage 19. The axis 20 of channel 19 of nozzle 18 may be defined as the resultant direction of the flow or of the jet, produced by this channel 19.

In the present description, the axis 20 of channel 19 of nozzle 18 is assumed to be orientated in the direction of the flow produced by the nozzle, this direction is shown in FIG. 2 by arrow 22.

It is obvious that without departing from the scope of the present invention nozzles may be used having passage sections of different shapes, which remains important given the direction and more exactly the orientation of the axis of these nozzles such as defined above.

The fluid from nozzle 9 is removed through the annular space 8 (FIG. 3) between the cutting face and the surface of the tool.

Figure 3:
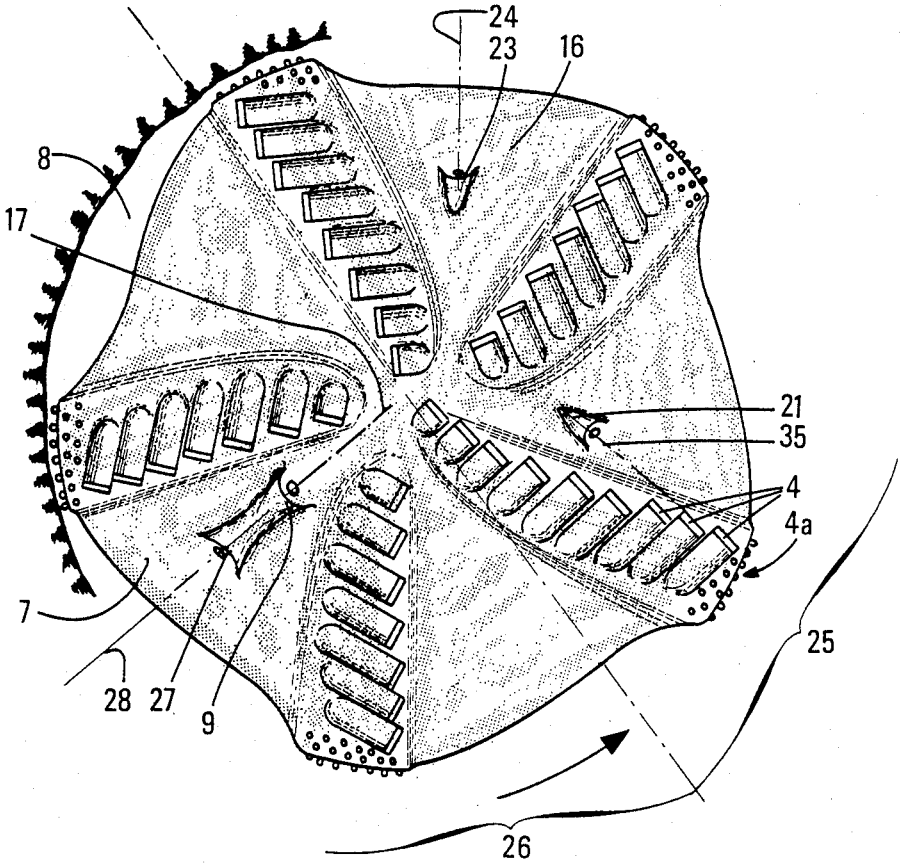
FIG. 3 shows a drilling tool comprising improvements according to the present invention.

The drilling head 1 of FIG. 3 comprises a second nozzle 23 which has an axis 24 directed towards the annular space 8.

This second nozzle is situated in a water passage 16 located on the side 25 of the drilling bit opposite the one containing the first nozzle and which is designated by the reference 26.

The so called opposite side 25 is defined by the portion of the tool situated in a first plane passing through the axis of the tool perpendicular to a second plane containing a point of the injection orifice of the first nozzle 9 as well as the axis of the drilling bit and which does not contain the first nozzle 9.

The tool of FIG. 3 which comprises an uneven number of water passages in this case 5, comprises an additional nozzle 21 orientated preferably towards the periphery of the tool and creates a flow directed respectively along axis 35, axis 35 being characterized by an angle $\beta$ (the definition of this angle is given hereafter), between 90° and 180° and which, in the precise case of FIG. 3, is substantially equal to 150°. In addition, in FIG. 3, the axis 35 of the jet created by nozzle 21 is orientated towards the working face of the cutting blades, which shows a particularly interesting configuration for cleaning these cutting blades.

Axis 24 of nozzle 23 is characterized by an angle $\beta$ equal to 180°.

This assembly formed by nozzles 9, 21 and 23 creates, in the central part of the tool, a flow of drilling fluid orientated substantially along the axis 17 of the first nozzle 9, while reducing swirls.

The drilling head of FIG. 3 comprises a third nozzle 27 which may be supplied with drilling fluid through the same bore as that supplying the first nozzle 9.

The axis 28 of the channel of this third nozzle 27 is orientated substantially in the direction opposite that of the first nozzle. By that it should be understood that the third nozzle 27 has a fluid injection channel which creates a flow moving away from the plane perpendicular to the axis 17 of the first channel.

Of course, the third nozzle 27 may be supplied through an independent bore, different from the one supplying the first nozzle 9.

Without departing from the scope of the present invention, one at least of the above mentioned nozzles may produce a jet which, as soon as it leaves said nozzle, is parallel to the cutting face and/or to the surface of the tool. This means that the axis of said nozzle is parallel to the cutting face and/or to the cutting surface of the tool.

Figure 4:
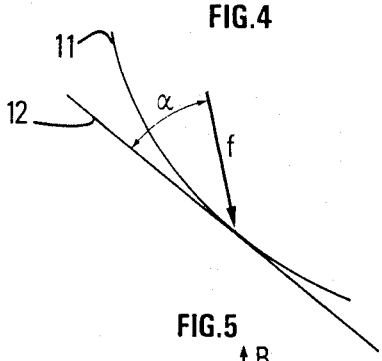
FIGS. 4 and 5 show diagrams for defining different angles.

In FIG. 4, reference 11 represents a cutting face such as it is cut by the tool. Reference 12 represents the plane tangent to the cutting face at the point of impact of the jet thereon.

Figure 5:
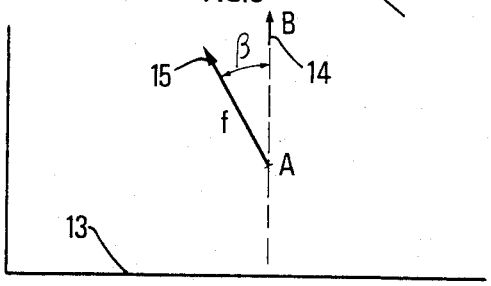

In FIG. 5, reference 13 represents the plane tangent to the cutting face at the point nearest the nozzle from which jet f is delivered. Reference 14 is the projection, orientated in the direction of advance of the tool, of the axis of tool 5 on plane 13. Reference 15 designates the projection of the path of jet f at the outlet of the nozzle in projection on plane 13. $\beta$ is the angle formed by projections 14 and 15. Angle $\beta$ is calculated from the half straight line AB where A is the point of intersection of projections 14 and 15.

Figure 6:
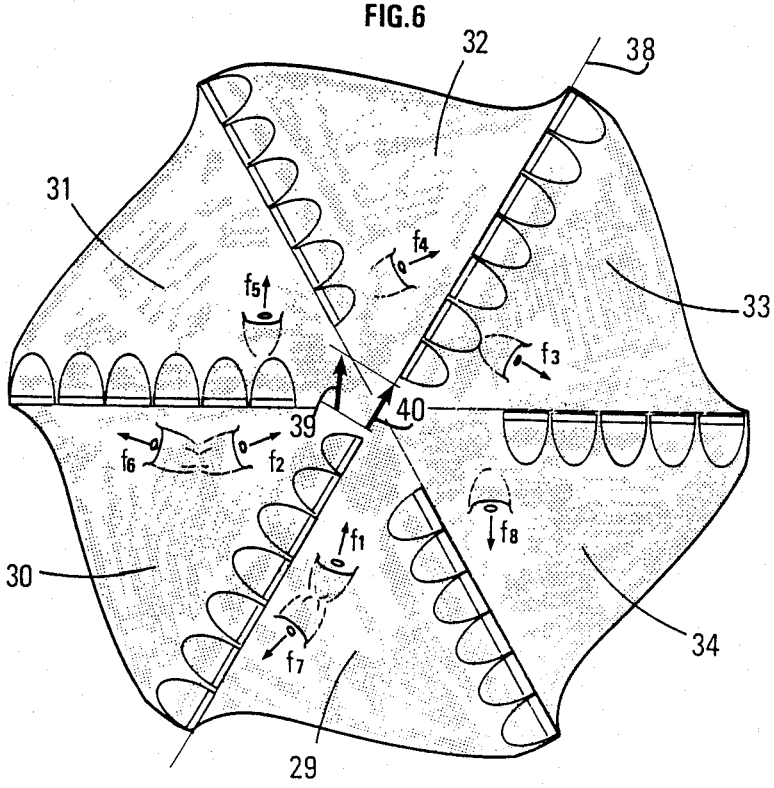
FIG. 6 shows a particularly efficient embodiment of a drilling tool comprising several nozzles in accordance with the invention.

FIG. 6 shows a tool having an even number of water passages, in this case 6. This tool has performed very well in removing spoil or cuttings during experimental tests.

The jets used are jets slanted with respect to the cutting face, so that the angle $\alpha$ which the jet f forms with the plane 12 tangent to the cutting face at the point of impact of this jet is different from 90°.

It is obvious that the direction of the jet merges substantially with the axis of the nozzle which produces One application of the invention, shown in FIG. 6, to a tool comprising six water passages referenced 29 to 34, consists in preferably orientating towards the central part of the tool the two jets referenced f1 and f2 situated in two adjacent water passages 29 and 30 and slanted respectively through angles $\alpha_1$ and $\alpha_2$ with respect to the cutting face, preferably towards the central part of the tool.

A jet orientated preferably towards the central part of the tool is any jet coming from a nozzle outside this central part 6 and the projection of the path of which on a plane perpendicular to the axis 5 of the tool is partially inside the projection on this plane of a central part 6 of the tool. Also considered as jet orientated preferably towards the central part of the tool is any jet coming from a nozzle inside this central part 6 and orientated preferably towards the center of the tool. A jet is called jet orientated preferably towards the central part of the tool when the angle $\beta$ defined in FIG. 5 has a value less than 90°.

Still within the scope of the present invention, the tool may comprise a single nozzle of oblong shape.

The plane of FIG. 6 corresponds to a plane perpendicular to the axis of the tool. Axis 38 represents the axis of circulation of the fluid.

Arrow 39 shows an effective speed vector obtained by the orthogonal projection on the plane of the Figure of a speed vector of the flow in the central part of the tool.

Reference 40 designates the circulation vector obtained by the orthogonal projection of the effective speed vector 39 on the circulation axis 38.

The circulation vector 40 may be obtained directly by projection of the flow speed along the circulation axis 38 on a plane perpendicular to the circulation axis 38.

The different circulation vectors of the central part of the tool are orientated in the same direction in the particular case of FIG. 6.

Jets $f_1$ and $f_2$ create, at the level of the central part of the tool 6, a privileged flow of the water passages 29 and 30 towards the water passages 32 and 33 allowing the spoil in this zone to be removed efficiently. The use of slanted jets allows a high flow speed of the fluid in this zone, by limiting the loss of speed of the jet at the level of the jet on cutting face impact.

Associated with jets $f_1$ and $f_2$, jets $f_3$ and $f_4$ in the water passages 32 and 33 improve the efficiency of the technique, by facilitating removal of the spoil pushed by $f_1$ and $f_2$ towards the annular zone of the tool.

Jets $f_3$ and $f_4$ also slanted respectively through angles $\alpha_3$ and $\alpha_4$ with respect to the cutting face are jets orientated preferably towards the periphery of the tool. A jet orientated preferably towards the periphery of the tool is any jet such that the previously defined angle $\beta$ is between 90° and 180°.

Jets $f_5$, $f_6$, $f_7$ and $f_8$ also slanted respectively through angles $\alpha_5$, $\alpha_6$, $\alpha_7$, and $\alpha_8$, with respect to the cutting face are orientated preferably towards the periphery of the tool.

Their purpose is to clean the cutting blades defining the water passage in which they are situated, respectively 31, 30, 29 and 34. Jets $f_3$ and $f_4$ also have this additional function.

The passage sections of the nozzles which will be noted $S_1$, $S_2$, . . . $S_8$ may be not all identical.

In the case of a tool comprising water passages, each water passage may comprise zero, one, or several jets.

If a water passage comprises several jets one of which is orientated preferably towards the central part of the tool, this jet will be the one situated the closest to the center of the tool, the center of the tool corresponds to the intersection of the outer surface of the second end of the tool with the axis of the tool 5.

The outlet section S of the nozzles may be circular, but may also have other shapes such as an oblong shape, the shape of a slit, etc.

If a tool comprises only a single nozzle, it will be orientated preferably towards the central part of the tool and will preferably have the shape of a slit.

Application of the invention leads to improved efficiency when all the jets are slanted with respect to the cutting face, but it keeps its value when one or more jets are not slanted with respect to the cutting face.

The value of the angle $\alpha$ for a slanted jet will be advantageously less than 45°.

The value of angle $\beta$ for a jet orientated preferably towards the central part of the tool will be advantageously less than 45°.

The number of jets orientated preferably towards the central part of the tool will be preferably less than or equal to the whole part of half the number of water passages.

The jets orientated preferably towards the central part of the tool will be preferably situated on the same side of a plane passing through the axis 5 of the tool so as to prevent these jets from being annihilated in the central part of the tool.

In the tool shown in FIG. 6, jets $f_3$, $f_4$, $f_5$, $f_6$, $f_7$, and $f_8$ which are not orientated towards the central part of the tool and whose function is in particular the cleaning of the surface of the tool in contact with the cutting face, this surface not comprising the central part of the tool, create a centrifugal flow orientated towards the cutting blades, which is particularly efficient for cleaning the tool and in particular its periphery.

The nozzles positioned on the tool may be removable or fixed, of identical section or not. Fixed nozzles may be formed by a simple channel formed directly in the body of the tool and having an appropriate slant of the injection orifice.

Generally, the sum of the sections of the jets orientated preferably towards the central part of the tool will be preferably greater than or equal to a third of the total passage section ST of the nozzles placed on the tool and preferably less than or equal to two thirds of the section ST.

Figure 7:
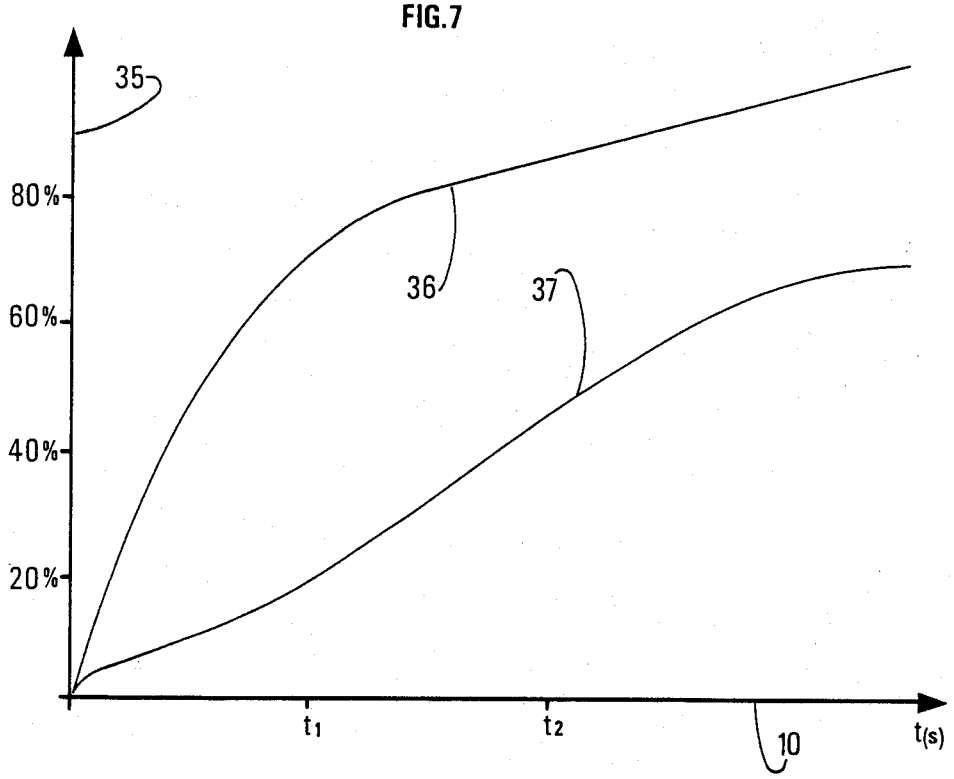
FIG. 7 shows a comparative diagram of the efficiency of a tool of the prior art and of a tool according to the present invention.

FIG. 7 is a diagram showing the gain provided by the invention in the capacity of the drilling tool to remove the spoil which is created at the bottom of the drilling well.

The axis of the ordinates 35 of this diagram shows the capacity of a tool in removing the spoil.

The axis 10 of the abscissa shows the time during which a drilling fluid is caused to pass into the tool.

In this Figure, reference 36 corresponds to the performance curve of the tool of the present invention and reference 37 corresponds to the performance curve of a tool of the prior art.

To obtain these curves, the tool is placed in a cell simulating the bottom of the drilling well. Between the tool and the well is introduced a given volume V of sand simulating the spoil.

During the experiment, a fluid was caused to flow at a given rate through the tool and the volume of spoil removed with respect to the volume of spoil initially placed in the cell was recorded as a function of time. The capacity of the tool in removing the spoil corresponds to the ratio of the volume of spoil removed with respect to the initial spoil volume V.

It will be noted on these curves that for a time of $t_1$, the tool of the invention removed a volume of spoil three times greater than that removed by the tool of the prior art.

In the case of the tool of the invention, with the spoil rapidly removed from the cutting face, the tool is therefore permanently in contact with the rock to be destroyed and not in contact with the spoil which it has just created. This results in increasing the feeding speed of the drilling tool and avoids recrushing of the spoil by this tool which would limit the efficiency of the tool and would cause initial wear thereof.

The performance curve 37 of the tool of the prior art substantially reaches a horizontal asymptote corresponding to a spoil removal capacity of the order of 60%, which means that the spoil remaining, namely 40% of the initial spoil is very difficult to remove.

On the contrary, the tool of the present invention leaves practically no spoil in the cell, because the central part of the tool in particular is well cleaned.

What is claimed is:

1. A method for improving the scavaging of cuttings from a drill tool rotating, in operation, about an axis of the tool, said tool comprising a body having a first end adapted for connection to rotary drive means and having a second end providing a cutting face, said second end having water passages, a zone of said second end surrounding said axis forming the central part of the tool, said tool comprising at least one nozzle wherein said nozzle is positioned in and in fluid communication with a water passage for producing a flow oriented towards the central part of the tool, the vector of the speed of flow obtained by the orthogonal projection on a plane perpendicular to the axis of the tool in the central part of the tool being different from zero at any point on said central part, said vector forming an effective speed vector.

2. The method as claimed in claim 1, applied to the case of a tool comprising several nozzles, wherein said nozzles are positioned and dimensioned so as to produce in the central part of the tool a resultant flow whose effective speed vector is zero at any point on said central part of the tool.

3. The method as claimed in claim 1, wherein a plurality of said nozzles are positioned so that there exists at least one axis, called circulation axis, belonging to said plane perpendicular to the axis of the tool, and wherein the different circulation vectors obtained by the orthogonal projection on said circulation axis of the different effective speed vectors of the points of the central part are orientated in the same direction.

4. A drilling tool for implementing the method claimed in claim 1, comprising at least a first nozzle positioned in and in fluid communication with a first water passage of the tool, said nozzle comprising a channel whose axis is oriented substantially towards the central part of the tool.

5. The drilling tool as defined in claim 4, comprising at least a second nozzle positioned in and in fluid communication with a second water passage located on the side of the tool opposite that having the first nozzle, said opposite side being defined by the portion of the tool situated in the half space defined by a first plane passing through the axis of the tool, perpendicular to a second plane containing a point of an injection orifice of said first nozzle as well as the axis of the tool, said second nozzle comprising a channel adapted for producing a flow substantially orientated in the direction opposite to that defined by the channel of the first nozzle to produce a flow of fluid away from the central part of the tool.

6. The tool as claimed in claim 5, wherein said point at the injection orifice of said second nozzle is positioned in and in fluid communication with a water passage substantially located on said opposite side of the tool substantially in a half plane belonging to said second plane, said half plane being defined by the axis of the tool.

7. The tool as claimed in claim 4, comprising several nozzles having fluid injection channels the axis of each being orientated towards the central part of the tool and wherein said nozzles are positioned in and in fluid communication with water passages located on the tool on the same side with respect to a plane passing through the axis of the tool.

8. The tool as claimed in claim 4, comprising a third nozzle having a third channel, said third nozzle being positioned substantially in the vicinity of said first nozzle, the axis of said third channel being orientated substantially in the direction opposite that of the first nozzle.

9. The drilling tool as claimed in claim 4, said tool comprising a number n of water passages greater than or equal to 3, further comprising a number m of water passages adjacent each other two by two, each of which comprise at least one nozzle having an injection channel orientated towards the central part of the tool, said number m being between one and the whole part of half the number n.

10. The drilling tool as claimed in claim 9, wherein at least one of the water passages other than those equipped with a nozzle having a channel with an axis orientated towards the central part of the tool is equipped with at least one nozzle having a channel substantially orientated in the direction opposite of that defined by the channel with axis orientated towards the central part of the tool to produce a flow of fluid away from the central part of the tool.

* * * * *